United States Patent [19]

Sanno

[11] Patent Number: 4,667,807

[45] Date of Patent: May 26, 1987

[54] APPARATUS FOR TAKING UP BOBBINS PLACED ON THE CONVEYOR

[75] Inventor: Hiroaki Sanno, Nonoichi, Japan

[73] Assignee: Murao Boki Kabushiki Kaisha, Kanazawa, Japan

[21] Appl. No.: 804,611

[22] Filed: Dec. 5, 1985

[30] Foreign Application Priority Data

Dec. 21, 1984 [JP] Japan ..... 59-271370

[51] Int. Cl.[4] ..... B65G 47/24

[52] U.S. Cl. ..... 198/412; 198/803.12; 198/598; 242/46; 221/214

[58] Field of Search ..... 221/78, 79, 81, 88, 221/214, 215, 268; 198/409, 803.01, 803.12, 598, 412; 242/35.5 A, 41, 46

[56] References Cited

U.S. PATENT DOCUMENTS

| | | | |
|---|---|---|---|
| 2,355,239 | 8/1944 | Read | 198/409 |
| 2,675,184 | 4/1954 | Abbott et al. | 242/35.5 A |
| 3,116,587 | 1/1964 | Du Buis et al. | 242/41 X |
| 3,148,495 | 9/1964 | King, Jr. et al. | 242/41 X |
| 3,631,965 | 1/1972 | Koshkin et al. | 198/803.12 X |
| 4,195,789 | 4/1980 | Mista | 242/35.5 A |
| 4,541,578 | 9/1985 | Kawarabashi et al. | 242/35.5 A |

*Primary Examiner*—Robert J. Spar
*Assistant Examiner*—Jay I. Alexander
*Attorney, Agent, or Firm*—Oblon, Fisher, Spivak, McClelland & Maier

[57] ABSTRACT

A bobbin feeding device includes a plurality of trays placed on a running belt under guidance of the side walls of the feeding device. Each tray includes a seat having a larger diameter than that of the bobbin, a bobbin supporting pin erected on the seat, and a boss having a smaller diameter than the bottom diameter of the bobbin. A shovel is pivotally connected to a terminating end of the bobbin feeding device. The shovel includes a groove having a width sufficient to enable the boss of the tray to fit into it. An actuator rotates the shovel so that each bobbin is scooped from its tray and slid down the shovel to a downstream production line.

3 Claims, 8 Drawing Figures

APPARATUS FOR TAKING UP BOBBINS PLACED ON THE CONVEYOR

BACKGROUND OF THE INVENTION

1. Field of the Invention

The present invention relates to apparatus for taking up bobbins placed on a conveyor, and more particularly, to apparatus for taking up bobbins, the apparatus including a rotary shovel adapted to receive the bobbins placed on a conveyor belt.

2. Description of the Prior Art

In yarn spinning, a line of process bobbin-wound or cheese-wound yarns as intermediate products are automatically conveyed on trays from one line to another. For this purpose each tray is equipped with a seat having a larger diameter than the bobbin diameter, and a pin around which the bobbin rests. In addition, a conveyor belt is provided for causing the trays to run with the bobbins thereon.

However, there is a problem involved in taking up these bobbins from the conveyor, in the form of stain and tangle of yarns, which are caused by the tools touching the yarns. Any stain and tangle will be a fatal defect to textile products.

OBJECTS AND SUMMARY OF THE INVENTION

The present invention aims at solving the problem pointed out above, and has for its object to provide an apparatus for taking up bobbins from the conveyor without the danger of staining or entangling the yarns on the bobbins.

Other objects and advantages of the present invention will become apparent from the detailed description given hereinafter. It should be understood, however, that the detailed description and specific embodiment are given by way of illustration only, since various changes and modifications within the spirit and scope of the invention will become apparent to those skilled in the art from this detailed description.

According to the present invention, there is provided an apparatus for taking up bobbins placed on the conveyor, the apparatus comprising:

a bobbin feeding device including a plurality of trays placed on a running belt under the guidance of the side walls of the feeding device, each tray including a seat having a larger diameter than that of the bobbin, a bobbin supporting pin erected on the seat and a boss having a smaller diameter than the bottom diameter of the bobbin;

a shovel means pivotally connected to a terminating end of the bobbin feeding device, the shovel including a groove having a width sufficient to enable the boss of the tray to fit in; and means for rotating the shovel so that the bobbin is scooped from the tray.

DETAILED DESCRIPTION OF THE INVENTION

Figure 7:
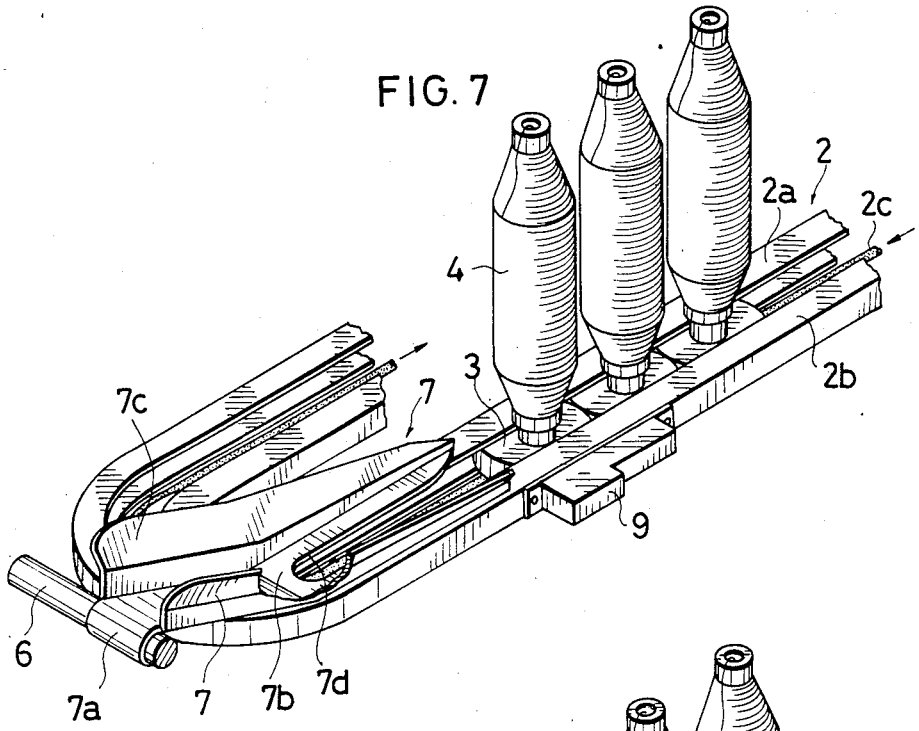
FIGS. 7 and 8 are perspective views on a larger scale showing the bobbin feeding device shown in FIGS. 1 and 2.
Figure 8:
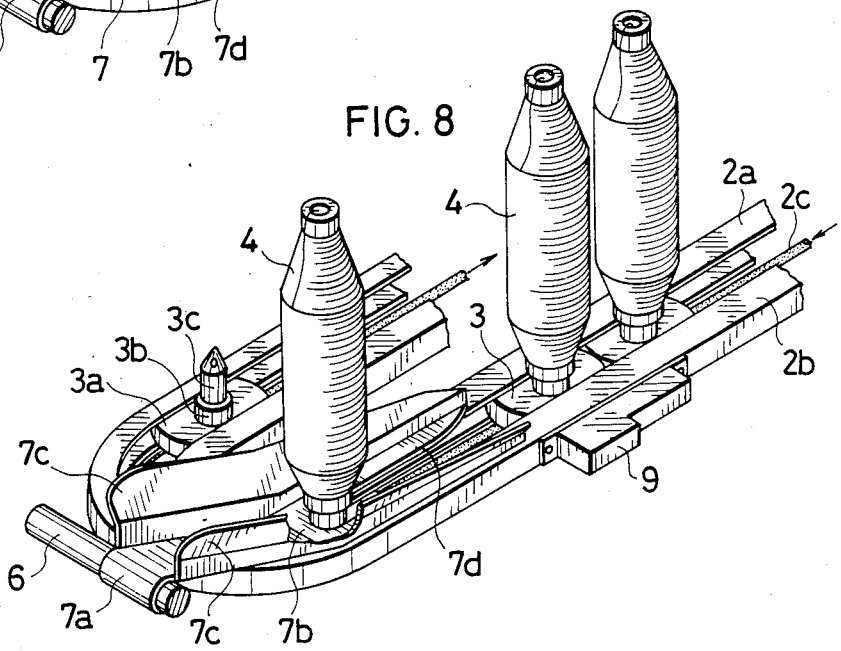

Referring to FIGS. 1 to 3, 7 and 8, the apparatus of the invention includes a bobbin feeding device 2 whereby bobbins 4 carried on trays 3 are fed one after another to a conveyor 12 in the next line of process. The bobbin feeding device 2 includes a pair of C-shaped steel bars 2*a*, 2*b*, which are arranged in parallel with each inner space being joined together. The reference numeral 2*c* denotes a belt having a round cross-section, which is caused to run in the direction indicated by an arrow 23. As shown in FIG. 8, each tray 3 includes a seat 3*a*, a boss 3*b* and a pin 3*c*. The boss 3*b* has a bigger outside diameter than the inside diameter of a bottom opening of the bobbin so as to enable the bobbins to rest thereon. The pin 3*c* is inserted in the bobbin 4, thereby securing it on the tray 3. The boss 3*b* and the pin 3*c* are projected beyond the surfaces of the bars 2*a*, 2*b*. The illustrated seat 3*a* is disc-shaped, but it can be varously shaped provided that the shape or the size is large enough to prevent the seat 3*a* from slipping through the two steel bars 2*a*, 2*b*. When the belt 2*c* is driven, the trays 3 are frictionally moved under the guidance of the steel bars 2*a*, 2*b*.

Figure 2:
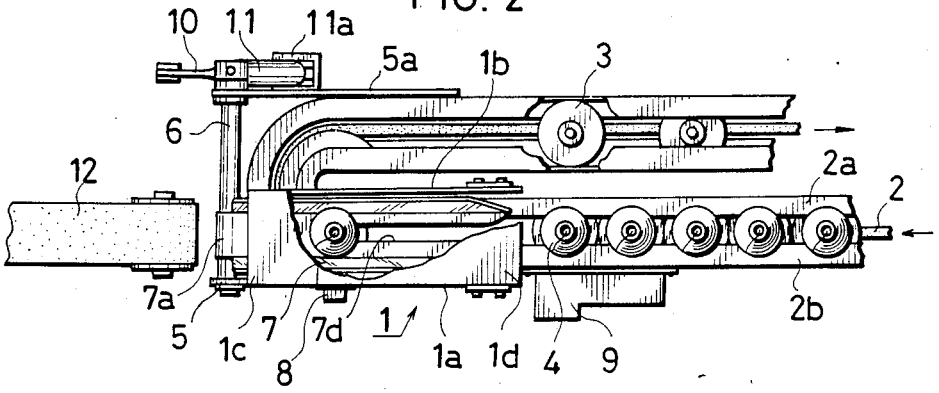
FIG. 2 is plan view showing the apparatus of FIG. 1.

The positional relationship between the apparatus of the invention and the bobbin feeding device 2 can be various; one example is shown in the drawings, in which the feeding device 2 is horizontally arranged in a bent form as best shown in FIG. 2. But it can be vertically arranged in a bent form. If it is not necessary to use the bobbin-free side of the device because bobbin-free trays are returned by some other device, the feeding device 2 can be employed in a straight form.

Each bobbin 4 has a yarn end slightly drawn from the top opening so as to facilitate the pick-up of yarns from the bobbins. The common practice is to blow the yarn end by wind supplied from downward through the bobbin hole, and lead it outside the top opening as best shown in FIGS. 7 and 8. To this end each tray 3 can be provided with a passageway through which the wind passes.

Figure 1:
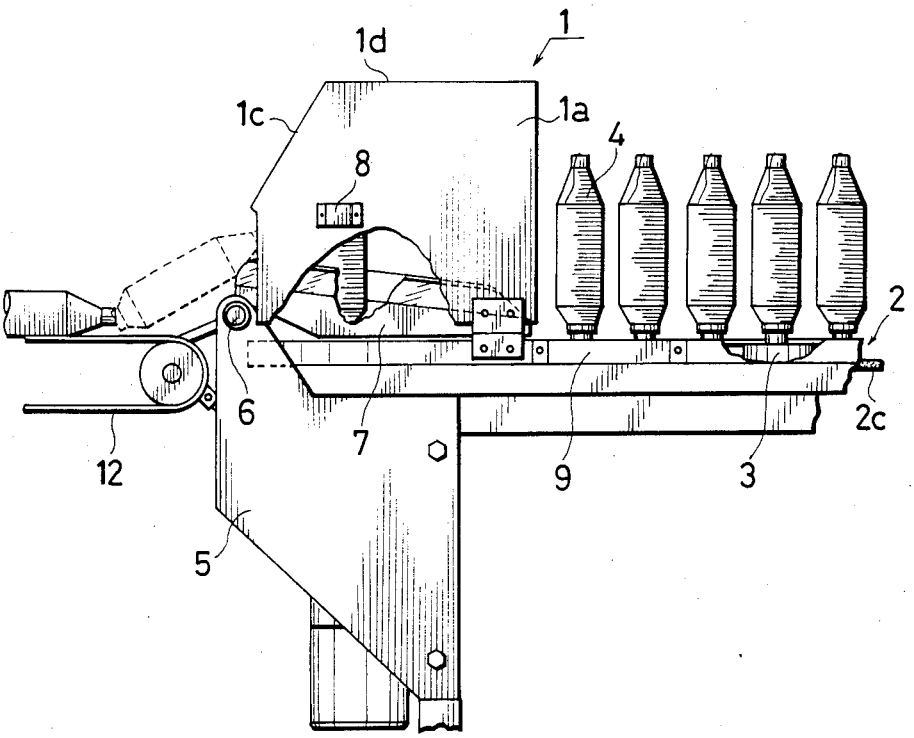
FIG. 1 is a side view, partly broken to show the internal structure, showing an apparatus embodying the present invention.
Figure 3:
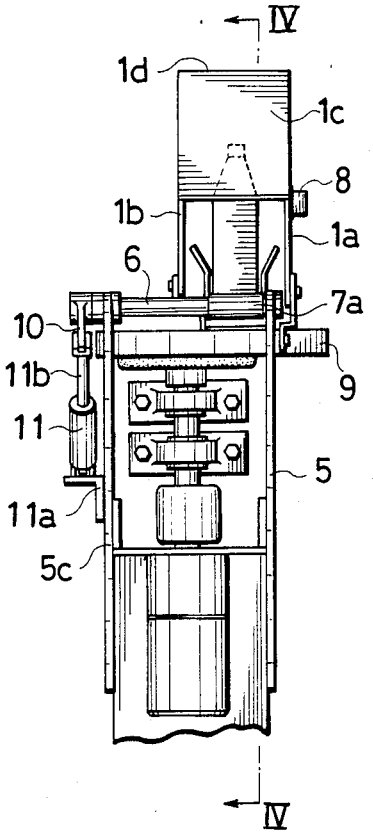
FIG. 3 is a left-hand front view showing the apparatus of FIG. 1.

In FIGS. 1 to 3 the reference numeral 1 denotes a covering, which is constituted by two side walls 1*a*, 1*b*, a ceiling 1*d* and a declined front wall 1*c*.

There are provided a pair of side panels 5, 5*a* below the covering 1, which side panels are carried on a common shaft 6. The reference numeral 7 denotes a shovel connected to the covering 1 at a point adjacent to the shaft 6. The shovel 7 includes a bottom 7*b* having an extended portion 7*a* jointed to the shaft 6, which bottom 7*b* is provided with a side wall 7*c* at each side. The top portion of each side wall 7*c* is outwardly bent. The bottom 7*b* is made as long as possible, and provided with a groove 7*d* at its center, the groove 7*d* being open in its terminal end so as to allow the trays to be led therein. In addition, the width of the groove 7*d* is sufficiently large to accommodate the boss 3*b* of the tray 3. The shovel 7 is located so that the groove 7*d* is in alignment with the bobbin feeding path, thereby enabling the boss 3*b* of each tray 3 to fit therein.

The shaft 6 is projected from the side panel 5*a*, and at this projecting portion, it is provided with a swinging arm 10 having its top end connected to a rod 11*b* of a cylinder 11 (pneumatic or hydraulic), which is supported by bracket 11*a*.

The reference numeral 8 denotes a detector, which detects whether a bobbin 4 is present on the tray 3 which has reached in the groove 7*d*. In response to the detection, the shovel 7 is operated. The detector 8 is constructed by a known device, such as a photoelectric tube. The detector 8 is located in place on the side wall 1*a*. Alternatively, it can be located at another place on the tray feeding side than the covering 1, whereby the shovel 7 is operated after the expiry of a predetermined time. It is also possible to arrange the detector 8 so that it moves in a declined posture so as to allow the empty trays to pass by. The reference numeral 9 denotes a regulator having a rod (not shown), which is projected toward the trays 3 or withdrawn therefrom. When the rod is projected toward one tray, the tray is held on the belt 2*c*, whereas the belt 2*c* continues to move leaving the arrested tray behind. When the rod is withdrawn, the released tray resumes moving on the moving belt 2*c*. Instead of the stopping rod, an escapement wheel can be employed, thereby enabling the trays to released one by one in one operation.

Figure 4:
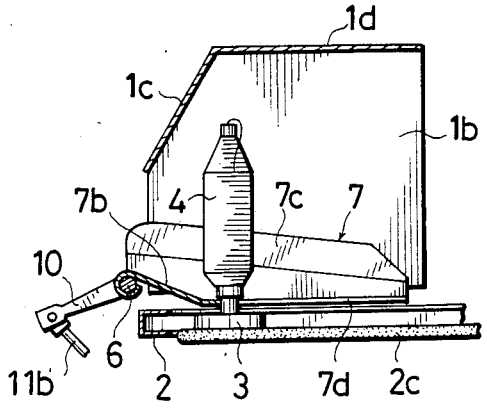
FIG. 4 is a cross-sectional view taken along the line IV—IV in FIG. 3.
Figure 5:
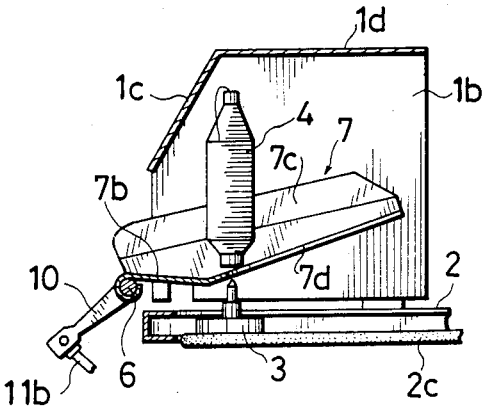
FIGS. 5 and 6 are schematic views exemplifying a sequence of operation.
Figure 6:
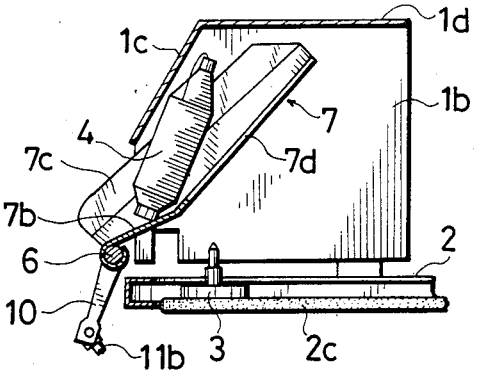

In operation, the shovel 7 shown in FIG. 7 is in its waiting posture. At this stage the stopping rod is withdrawn so as to enable a tray 3 that it has previously arrested to resume its movement. The tray 3 is led into the groove 7*d* as shown in FIG. 8, and stops at the bottom of the groove 7*d*. This is detected by the detector 8 upon receiving the signal from the detector 8, the cylinder 11 operates. The shovel 7 is operated in the sequence shown in FIGS. 4, 5 and 6. When it takes an erected posture, the shovel 7 functions as a chute whereby the bobbin 4 is released from the tray 3, turned on its side, and slid down onto the conveyor 12 in the next line of process. The operation will be described more in detail:

First, the cylinder 11 operates, thereby enabling the swinging arm 10 to rotate in the counter-clockwise direction. This enables the shaft 6 to rotate in the counter-clockwise direction, thereby causing the shovel 7 to rotate and take an erected posture. The raised bobbin comes into abutment with the declined front wall 1*c* as shown in FIG. 6. The chute is defined by the bottom 7*b* and the side walls 7*c*. Preferably the declined front wall 1*c* is provided with an opening or a lattice window, which allows the operator to watch inside. The bobbins 4 are delivered onto the conveyor 12 in a subsequent line of process. The bobbin-free trays 3 are fed along the other side of the feeding device 2 as best shown in FIG. 2.

As is evident from the foregoing description, the bobbin take-up apparatus of the invention has many advantages. One advantage is that the structure is considerably simplified, and another advantage is that the bobbins are securely taken up from the conveyor. A third advantage is that the taken-up bobbins are delivered to the next line of process in orderly postures, which facilitates the subsequent operation upon the yarn. A further advantage is that the yarn is safe from a stain or tangle likely to occur in the course of taking up process.

What is claimed is:

1. An apparatus for transferring bobbins from a first conveyor line in which each bobbin is mounted in vertical orientation to a second conveyor line in which each bobbin is disposed on its side, said apparatus comprising:

(a) a bobbin feeding device comprising a plurality of trays which, in use, are placed on the first conveyor line, each one of said plurality of trays comprising, in order, a seat having a larger diameter than the external diameter of the bobbins, a boss having a larger diameter than the internal diameter of the bobbins, and a pin having a smaller diameter than the internal diameter of the bobbins, whereby, in use, each bobbin receives a corresponding one of said pins and is supported by a corresponding one of said bosses;

(b) a shovel which, in use, is mounted for pivotal movement between a first position in which it extends over and at least approximately parallel to the first conveyor line and a second position in which it extends at a steep angle to the first conveyor line, said shovel having a groove therein that is wide enough to permit the boss of each one of said plurality of trays to be received therein but narrow enough so that the bobbins cannot pass therethrough, the groove in said shovel being shaped and positioned so that the boss of each successive tray-and-bobbin combination enters into the groove when said shovel is in its first position and so that, as said shovel pivots from its first position to its second position, each successive bobbin is lifted off the boss and the pin of the corresponding one of said plurality of trays;

(c) means for pivoting said shovel back and forth between its first position and its second position; and (d) a declined front wall positioned so that, as said shovel moves from its first position to its second position, said declined front wall contacts each successive bobbin and pivots it from a vertical position to an on-its-side position disposed on said shovel, in which position each successive bobbin slides down said shovel and onto the second conveyor line.

2. An apparatus as recited in claim 1 wherein said means comprise:

(a) a shaft on which said shovel is mounted;

(b) a bell crank connected to said shaft; and (c) a pneumatic or hydraulic cylinder operatively connected to bell crank.

3. An apparatus as recited in claim 1 and further comprising a detecting means disposed adjacent to said shovel to detect the presence of a bobbin-and-tray combination in the groove in said shovel when said shovel is in its first position.

* * * * *